US006897714B2

(12) United States Patent
Mori

(10) Patent No.: US 6,897,714 B2
(45) Date of Patent: May 24, 2005

(54) REFERENCE VOLTAGE GENERATING CIRCUIT

(75) Inventor: Haruya Mori, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/212,788

(22) Filed: Aug. 7, 2002

(65) Prior Publication Data

US 2003/0030482 A1 Feb. 13, 2003

(30) Foreign Application Priority Data

Aug. 10, 2001 (JP) ..... 2001-243808

(51) Int. Cl.[7] ..... G05F 1/46
(52) U.S. Cl. ..... 327/541; 327/543; 323/316
(58) Field of Search ..... 327/538–541, 327/543; 323/312–316, 907; 363/73

(56) References Cited

U.S. PATENT DOCUMENTS 4,763,021 A * 8/1988 Stickel ..... 326/71
4,783,607 A * 11/1988 Hsieh ..... 326/71
5,373,226 A * 12/1994 Kimura ..... 327/541
5,495,184 A * 2/1996 Des Rosiers et al. ..... 326/73
5,847,556 A * 12/1998 Kothandaraman et al. .. 323/316
5,942,933 A * 8/1999 Yang ..... 327/530
6,111,396 A * 8/2000 Lin et al. ..... 323/907
6,323,630 B1 * 11/2001 Banba ..... 363/73

FOREIGN PATENT DOCUMENTS

JP 61-172435 8/1986 ..... H03K/19/094

* cited by examiner

*Primary Examiner*—Timothy P. Callahan
*Assistant Examiner*—Terry L. Englund
(74) *Attorney, Agent, or Firm*—Morrison & Foerster LLP

(57) ABSTRACT

A semiconductor integrated circuit has an output end, an N-channel MOS transistor having the drain thereof connected to the output end, and a P-channel MOS transistor having the drain thereof connected to the output end. The semiconductor integrated circuit further has an operational amplifier having the non-inverting input terminal thereof connected to the output end, receiving a voltage at the inverting input terminal thereof, and having the output terminal thereof connected to the gate of the P-channel MOS transistor. In coordination with the P-channel MOS transistor, the operational amplifier operates so as to keep the voltage at the output end equal to the voltage fed thereto.

3 Claims, 6 Drawing Sheets

REFERENCE VOLTAGE GENERATING CIRCUIT

BACKGROUND OF THE INVENTION

1. Field of the Invention

The present invention relates to a semiconductor integrated circuit, and particularly to an analog semiconductor integrated circuit and a reference voltage generating circuit having MOS transistors with an effective channel length of about 1 μm or less and fabricated by a submicron CMOS process.

2. Description of the Prior Art

In a MOS transistor, an effective channel length of 1 μm or less makes the electric field around the drain so high as to produce so-called hot carriers, i.e., carriers accelerated to high speed by such an electric field. Hot carriers jump into the gate oxide film of the MOS transistor, varying the threshold level and transconductance of the MOS transistor. Moreover, hot carriers collide with the atoms constituting the semiconductor around the drain and newly produce impact carriers, which generate a substrate current that flows from the drain to the substrate. Hot carriers are especially likely to appear when the drain-to-source voltage of the MOS transistor is high and the gate-to-source voltage is intermediate, i.e., about 1 to 2 V.

This is called the hot carrier problem, which is considered a big problem that lowers the reliability of a semiconductor integrated circuit. To overcome this problem, in a conventional submicron CMOS process, it has been customary to alleviate the electric field around the drain by improving the fabrication process and lowering the supply voltage.

In a case where a MOS transistor is used in a digital semiconductor integrated circuit that uses it as a switching device, when the MOS transistor is completely on, whereas the drain-to-source voltage is low, the gate-to-source voltage is sufficiently high; when the MOS transistor is off, whereas the drain-to-source voltage is high, the gate-to-source voltage is sufficiently low. Thus, hot carriers are likely to appear only during transition periods in which switching takes place. Moreover, even if hot carriers vary the threshold voltage and transconductance of the MOS transistor slightly, this does not greatly affect the operation and function of the digital semiconductor integrated circuit.

Therefore, the aforementioned measures against hot carriers helps to secure satisfactorily high reliability in practical terms. Lowering the supply voltage can increase the transmission delay time through the circuit and thus reduce its operating speed. However, the shorter effective channel length reduces the parasitic capacitance of the MOS transistor and thus enhances the transconductance. This makes the transmission delay time through the MOS transistor eventually shorter than it conventionally is, and therefore, even if the supply voltage is lowered, it is possible to maintain or even enhance the operating speed of the digital semiconductor integrated circuit.

By contrast, in an analog semiconductor integrated circuit that applies an intermediate voltage between the gate and source of a MOS transistor so as to use it as a device for controlling a current, hot carriers are likely to appear especially when the drain-to-source voltage is high. Moreover, this state lasts as long as the MOS transistor operates. Thus, here, as compared with a digital semiconductor integrated circuit in which hot carriers appear only transiently, hot carriers have a more serious effect.

Moreover, analog semiconductor integrated circuits are often required to operate from a wide range of supply voltages, and their circuit configuration does not permit the supply voltage to be lowered sufficiently. Thus, with analog semiconductor integrated circuits, it is not so easy to lower the supply voltage as with digital semiconductor integrated circuits. In addition, variations in the threshold voltage and transconductance of the MOS transistor, which have little effect in digital semiconductor integrated circuits, lead directly to variations in circuit characteristics in analog semiconductor integrated circuits. Furthermore, the substrate current generated by hot carriers makes the drain current and source current of the MOS transistor unequal, causing large errors in circuit characteristics (i.e., large deviations from the current and voltage characteristics as designed).

The serious effect of hot carriers described above has long been preventing analog semiconductor integrated circuits from further miniaturization in applications where a supply voltage of 5 V or higher is required, forcing the use of transistors with effecitge channel lengths of 1 μm or more. On the other hand, analog semiconductor integrated circuits using transistors with effective channel lengths of 1 μm or less operate from a supply voltage as low as 3 V at most so as not to make the drain-to-source voltage too high, and, as described above, their circuit configuration does not permit the supply voltage to be lowered sufficiently. Thus, it has been possible only to fabricate analog semiconductor integrated circuits that operate from a narrow range of supply voltages.

In recent years, however, in response to increasing demand for higher operating speed, lower operating voltage, and lower power consumption in logic semiconductor integrated circuits, facilities based on a CMOS semiconductor fabrication process have been quickly shifting to those designed for effective channel lengths of 1 μm or less, and this has been making increasingly difficult to fabricate analog semiconductor integrated circuits with effective channel lengths of 1 μm or more. Moreover, demand for analog/digital hybrid semiconductor integrated circuits has been increasing the need to mixedly form a logic semiconductor integrated circuit and an analog semiconductor integrated circuit on a single substrate.

SUMMARY OF THE INVENTION

An object of the present invention is to provide an analog semiconductor integrated circuit and a reference voltage generating circuit that do not cause the hot carrier problem even when fabricated by a fabrication process for an effective channel length of 1 μm or less and operated from a wide range of supply voltages.

In general, when P-channel and N-channel MOS transistors fabricated by an identical CMOS semiconductor fabrication process are compared, the variations in device characteristics and the substrate current ascribable to hot carriers are about two orders of magnitude smaller in P-channel MOS transistors than in N-channel MOS transistors. This is because impact carriers are less likely to appear in P-channel MOS transistors than in N-channel MOS transistors, and because P-channel MOS transistors have gentler impurity profiles in the source-to-drain region, and thus lower electric fields around the drain, than N-channel MOS transistors.

This fact has been exploited in the present invention to solve the problems mentioned above. Specifically, according to the present invention, as shown in FIG. 1, a transistor circuit 2 including a first MOS transistor 1 of an N-channel type of which the drain serves as the output end of the circuit is further provided with a second MOS transistor 5 of a P-channel type and an operational amplifier 6. The second MOS transistor 5 has the drain thereof connected to the output end 3 of the transistor circuit 2, and has the source thereof connected to a first terminal 4. The operational amplifier 6 has the non-inverting input terminal (+) thereof connected to the output end 3 of the transistor circuit 2, receives a first voltage $E_1$ at the inverting input terminal (−) thereof, and has the output terminal thereof connected to the gate of the second MOS transistor 5. In the figure, the symbols "D" and "S" represent the drain and source, respectively, of a transistor.

In this circuit configuration, the operational amplifier 6 amplifies the difference between the voltage at the non-inverting input terminal thereof and the voltage at the inverting input terminal thereof (i.e., the first voltage $E_1$) and outputs the result. Accordingly, if the drain voltage of the first MOS transistor 1 is lower than the first voltage $E_1$, the output of the operational amplifier 6, and thus the gate voltage of the second MOS transistor 5, falls, increasing the drain current of the second MOS transistor 5 and thus making the drain voltage of the first MOS transistor 1 higher. By contrast, if the drain voltage of the first MOS transistor 1 is higher than the first voltage $E_1$, the gate voltage of the second MOS transistor 5 rises, decreasing the drain current of the second MOS transistor 5 and thus making the drain voltage of the first MOS transistor 1 lower.

In this way, the drain voltage of the first MOS transistor 1 is kept equal to the first voltage $E_1$. Typically, an intermediate voltage of about 1 to 2 V is applied to the gate of the first MOS transistor 1. By setting the first voltage $E_1$ in such a way that the drain-to-source voltage of the first MOS transistor 1 is sufficiently low, it is possible to prevent the first MOS transistor 1 from causing the hot carrier problem even when the voltage at the first terminal rises.

If this circuit configuration according to the present invention is not adopted, i.e., if the drain of the first MOS transistor 1 is connected directly to the first terminal 4 as shown in FIG. 8, when the voltage at the first terminal 4 is high, the drain-to-source voltage of the first MOS transistor 1 is high, and the gate-to-source voltage is intermediate. This causes the hot carrier problem, leading to degraded characteristics and lower reliability. By contrast, by adopting the circuit configuration according to the present invention, it is possible to avoid such lowering of reliability.

In the present invention, it is essential that the second MOS transistor 5 be a P-channel MOS transistor. The reason is that, as described above, the variations in device characteristics and the substrate current ascribable to hot carriers are about two orders of magnitude smaller in P-channel MOS transistors than in N-channel MOS transistors and therefore, with a P-channel MOS transistor here, even when the voltage at the first terminal 4 rises and thus the drain-to-source voltage of the second MOS transistor 5 rises, the effect of hot carriers is so slight as to be negligible. If the second MOS transistor 5 is an N-channel MOS transistor, even when the hot carrier problem is avoided in the first MOS transistor 1, the second MOS transistor 5 causes it.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
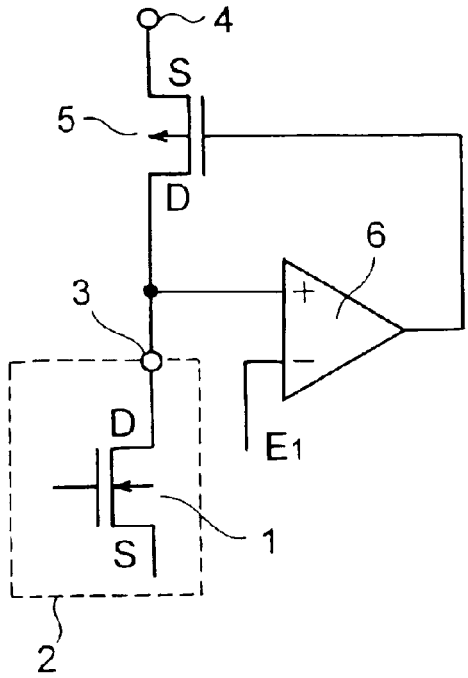
FIG. 1 is a diagram showing the basic circuit configuration, and simultaneously a first embodiment, of the invention.
Figure 2:
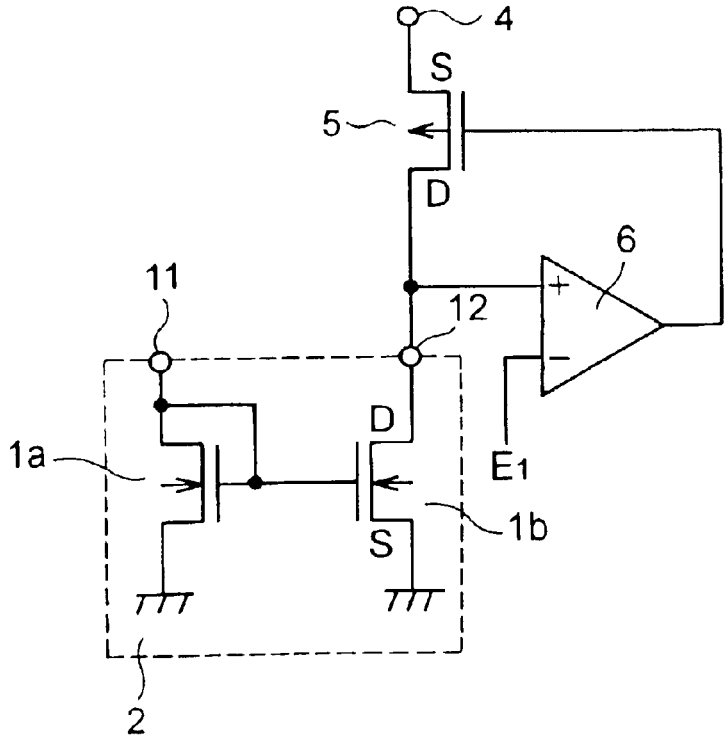
FIG. 2 is a diagram showing a second embodiment of the invention.

FIG. 1 has already been described. Hereinafter, embodiments of the present invention shown in FIGS. 2 to 7 will be described. FIG. 2 shows an embodiment in which the transistor circuit 2 is expanded into a so-called current mirror circuit that has a current input end 11 and a current output end 12 and that operates in such a way as to keep at a constant value the ratio of the current flowing at the current input end 11 to the current flowing at the current output end 12.

The current mirror circuit shown in the figure is merely a typical example, and, in practice, current mirror circuits of various circuit configurations are widely used. Needless to say, the present invention applies to current mirror circuits of any circuit configuration. In FIG. 2, the current mirror circuit is formed by two N-channel MOS transistors 1*a* and 1*b*, which are generally so designed that their effective channel lengths are equal and that the ratio of the effective channel width of one to that of the other is equal to the desired current ratio. In this current mirror circuit, the voltage at the current input end 11 is equal to the gate-to-source voltage of the MOS transistor 1*a*, typically about 1 to 2 V.

On the other hand, the voltage at the current output end 12 varies from case to case. For example, a voltage of about 5 V may be applied to the current output end 12. In that case, in the MOS transistor 1*b*, if fabricated by a semiconductor fabrication process for an effective channel length of 1 $\mu$m or less, typically a voltage of about 1 to 2 V is applied between the gate and the source, and a voltage of about 5 V is applied between the drain and the source. This produces hot carriers. The resulting substrate current that flows from the drain of the MOS transistor 1*b* to the substrate increases the drain current of the MOS transistor 1*b*, making the current ratio of the current mirror circuit higher than designed.

Moreover, the threshold voltage and transconductance of the transistors 1*a* and 1*b* vary with time as they are energized, and thus the current ratio, instead of remaining as designed, varies with time as those transistors are energized. By contrast, with the circuit configuration according to the present invention, even when the voltage at the terminal 4 is high, it is possible to induce the drain voltage of the MOS transistor 1*b* to approach the level determined by the first voltage $E_1$ and then keep it at that voltage $E_1$. In this way, it is possible to avoid the problems mentioned above.

Figure 3:
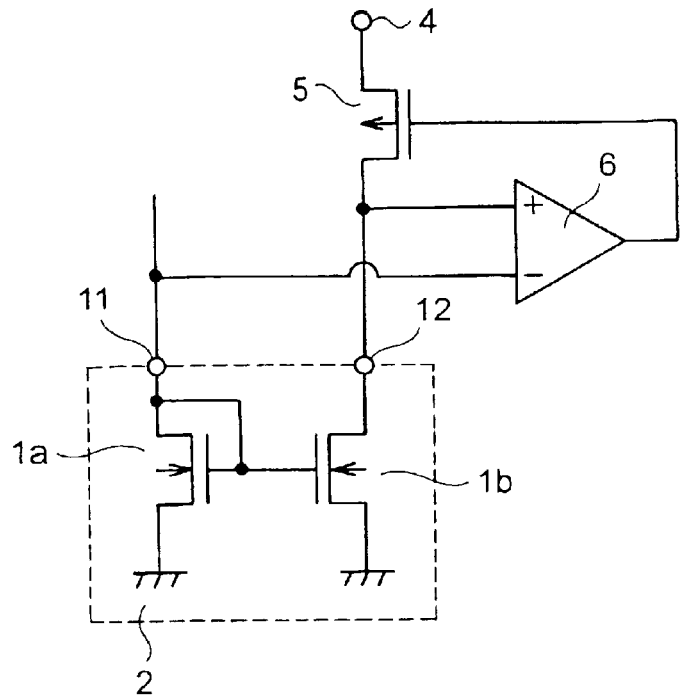
FIG. 3 is a diagram showing a third embodiment of the invention.

FIG. 3 shows an embodiment that differs from the embodiment shown in FIG. 2 only in that the inverting input terminal (−) of the operational amplifier 6 is connected to the input terminal 11 of the transistor circuit (current mirror circuit) 2. In other respects, this embodiment is the same as the previous one. In a current mirror circuit as the one constituting the transistor circuit 2 in FIG. 2, the current ratio is affected also by the relationship between the voltage at the current input end 11 and the voltage at the current output end 12.

This is because the transconductance of a MOS transistor is a function of not only the gate-to-source voltage but also the drain-to-source voltage. Thus, the current ratio of the current mirror circuit shown in FIG. 2 is precisely equal to the designed current ratio only when the voltage at the current input end 11 and the voltage at the current output end 12 are equal. Whereas typically the voltage at the current input end 11 is substantially constant at about 1 to 2 V, the voltage at the current output end 12 varies widely depending on the load. Thus, the condition mentioned above cannot always be fulfilled.

By contrast, with the circuit configuration shown in FIG. 3, the voltage at the current output end 12 can be set freely according to the first voltage $E_1$ within the range in which the MOS transistor 1*b* does not cause the hot carrier problem. In addition, the inverting input terminal (−) of the operational amplifier 6 is connected to the current input end 11 of the current mirror circuit so that the first voltage $E_1$ is equal to the voltage at the current input end 11 of the current mirror circuit. This makes the voltages at the terminals 11 and 12 equal, and thereby makes it possible to keep the current ratio of the current mirror circuit precisely equal to the designed current ratio irrespective of the voltage at the first terminal 4.

Figure 4:
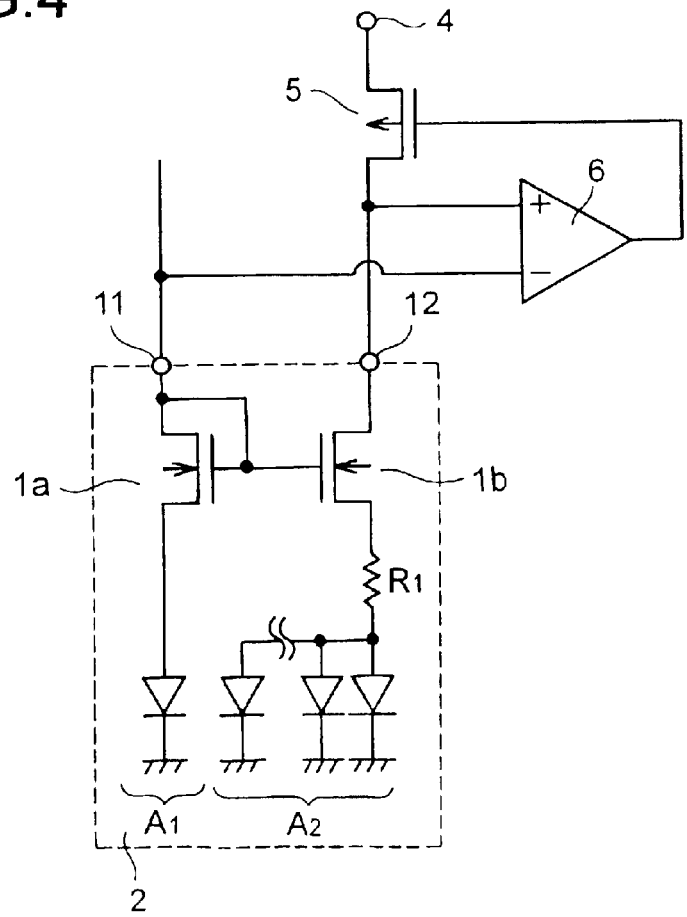
FIG. 4 is a diagram showing a fourth embodiment of the invention.

This circuit configuration applies not only in cases where the transistor circuit 2 is a current mirror circuit but also in cases where, as in an embodiment shown in FIG. 4, the transistor circuit 2 is so configured that the ratio of the current at the current input end 11 to the current at the current output end 12 is kept at a constant value when the current flowing at the current input end 11 has a particular value. In FIG. 4, between the source of the MOS transistor 1*a* and ground, a diode circuit $A_1$ composed of one diode is connected, and, between the source of the MOS transistor 1*b* and ground, a diode circuit $A_2$ composed of a plurality of parallel-connected diodes is connected through a resistor R1. It is to be noted that the circuit shown in FIG. 4 is applied to the band gap reference voltage generating circuit shown in FIG. 6 and described later.

The circuit shown in FIG. 3 will be further considered. As described above, the circuit configuration shown in FIG. 3 makes it possible to keep at a constant value the ratio of the current flowing at the current input end 11 to the current flowing at the first terminal 4 (which is equal to the current flowing at the current output end 12) irrespective of the voltage at the first terminal 4. On the other hand, the voltage at the current input end 11 differs from the voltage at the first terminal 4. There exist applications, however, in which these two voltages need to be equal, as in the band gap reference voltage generating circuit described later.

Figure 5:
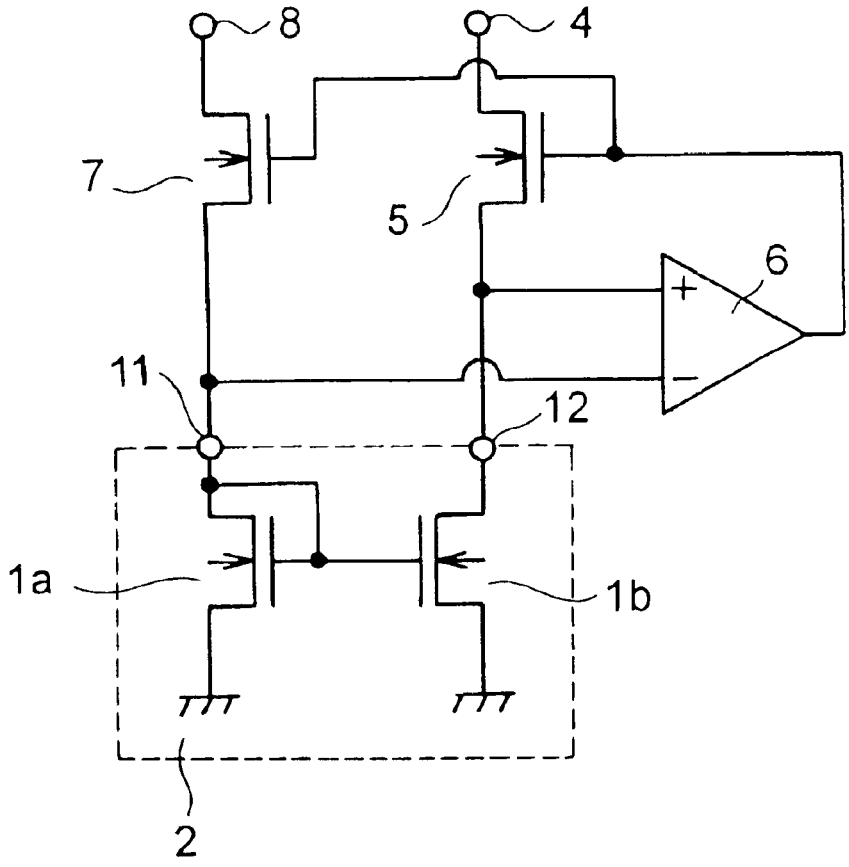
FIG. 5 is a diagram showing a fifth embodiment of the invention.

In such a case, it is advisable, as shown in FIG. 5, to connect another P-channel MOS transistor 7 to the input side of the circuit shown in FIG. 3. Specifically, a third MOS-transistor 7 of a P-channel type is added that has the drain thereof connected to the current input end 11, has the source thereof connected to a second terminal 8, and has the gate thereof connected to the gate of the second MOS transistor 5. This third MOS transistor 7 and the second MOS transistor 5 are so formed that their effective channel lengths are equal and that the ratio of the effective channel width of one to that of the other is equal to the current ratio of the current mirror circuit.

This makes the gate-to-source voltages of the third MOS transistor 7 and the second MOS transistor 5 equal, and thereby makes it possible to keep at a constant value the ratio of the current flowing at the second terminal 8 (which is equal to the current flowing at the current input end 11) to the current flowing at the first terminal 4 (which is equal to the current flowing at the current output end 12) irrespective of the voltage at the first terminal 4. In addition, the voltage at the second terminal 8 and the voltage at the first terminal 4 are kept equal. It is to be noted that the circuit configuration shown in FIG. 5 applies also in a case where the transistor circuit 2 shown in the figure is replaced with the transistor circuit 2 shown in FIG. 4.

Figure 6:
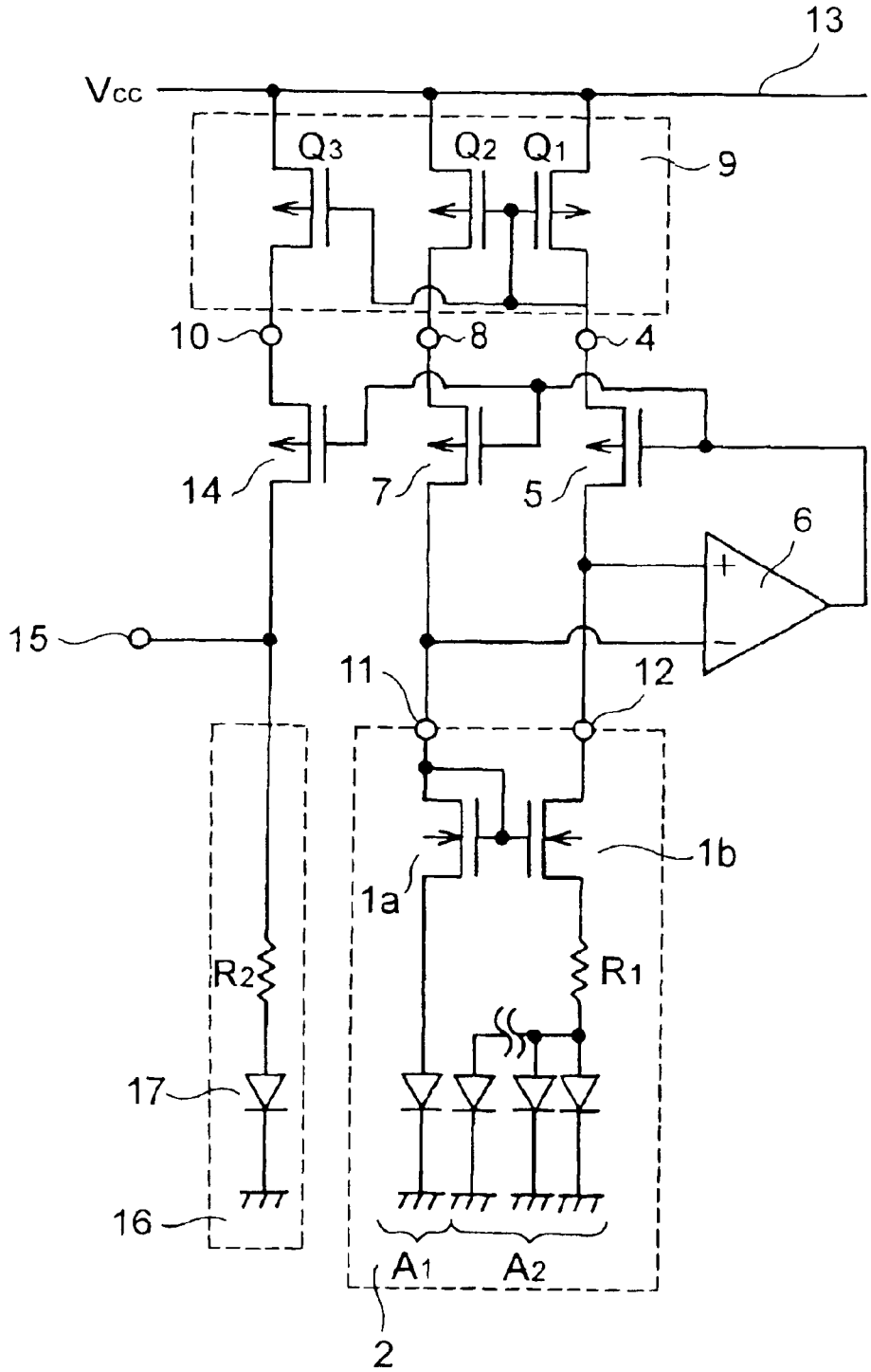
FIG. 6 is a diagram showing a sixth embodiment of the invention.

FIG. 6 shows a modified version of the circuit shown in FIG. 5, in which the transistor circuit 2 is replaced with the transistor circuit 2 shown in FIG. 4, and a current mirror circuit 9 including P-channel MOS transistors Q1 and Q2 is connected to the first and second terminals 4 and 8. In this current mirror circuit 9, the transistor Q1 has the source thereof connected to a supply voltage line 13 for supplying a voltage $V_{cc}$, and has the drain and gate thereof connected to the first terminal 4. The transistor Q2 has the source thereof connected to the supply voltage line 13, has the gate thereof connected to the first terminal 4, and has the drain thereof connected to the second terminal 8.

The current mirror circuit 9 further has a P-channel MOS transistor Q3 that has the source thereof connected to the supply voltage line 13, has the gate thereof connected to the first terminal 4, and has the drain thereof connected to a third terminal 10. Also connected to the third terminal 10 is the source of a P-channel MOS transistor 14. The P-channel MOS transistor 14 has the gate thereof connected to the output terminal of the operational amplifier 6, and has the drain thereof connected to a VBG (voltage band gap) terminal 15. A reference voltage extraction circuit 16 is connected to the VBG terminal 15 and to the drain of the transistor 14.

This circuit 16 is composed of a resistor R2 and a diode 17, and the cathode of the diode 17 is connected to ground. From the VBG terminal 15, a constant voltage is obtained as a reference voltage. Thus, FIG. 6 shows an example of a band gap reference voltage generating circuit configured in combination with a reference voltage extraction circuit 16.

This circuit exploits the fact that, when the current I flowing at the current input end 11 of the transistor circuit 2 has a particular value determined by the resistance $R_1$ and the area ratio N of the diodes $A_1$ and $A_2$, specifically, when $$I=(k\times t\times ln(n))/(q\times R) \quad (1)$$

(where k represents the Boltzmann constant, t represents the absolute temperature, and q represents the electric charge of an electron), the current at the current input end and the current at the current output end are equal, and match with the current ratio of the P-channel current mirror circuit 9. Thus, at the VBG terminal 15 appears a constant voltage that varies very little even when the supply voltage $V_{cc}$ varies.

By setting the ratio of $R_1$ to $R_2$ appropriately, it is possible to cancel the positive temperature coefficient of equation (1) with the negative temperature coefficient of the forward voltage drop of the diodes and thereby almost eliminate the temperature dependence of the VBG terminal 15. Moreover, thanks to the effect of the present invention applied to this circuit, even when the supply voltage $V_{cc}$ varies greatly, the MOS transistors 1*a* and 1*b* included in the transistor circuit 2 do not cause the hot carrier problem, the voltages at the current input end 11 and the current output end 12 of the transistor circuit 2 can be kept equal, and the voltage at the first terminal 4, which corresponds to the current input end of the P-channel current mirror circuit 9, and the voltages at the second and third terminals 8 and 10, which correspond to the current output end, can be kept equal. Thus, it is possible to realize a highly reliable reference voltage generating circuit in which the VBG voltage varies very little even when the supply voltage $V_{cc}$ varies greatly or even when the circuit is energized for an extended period of time. It is to be noted that, in practice, this circuit requires a starting circuit that starts the circuit when electric power starts being supplied thereto.

Figure 7:
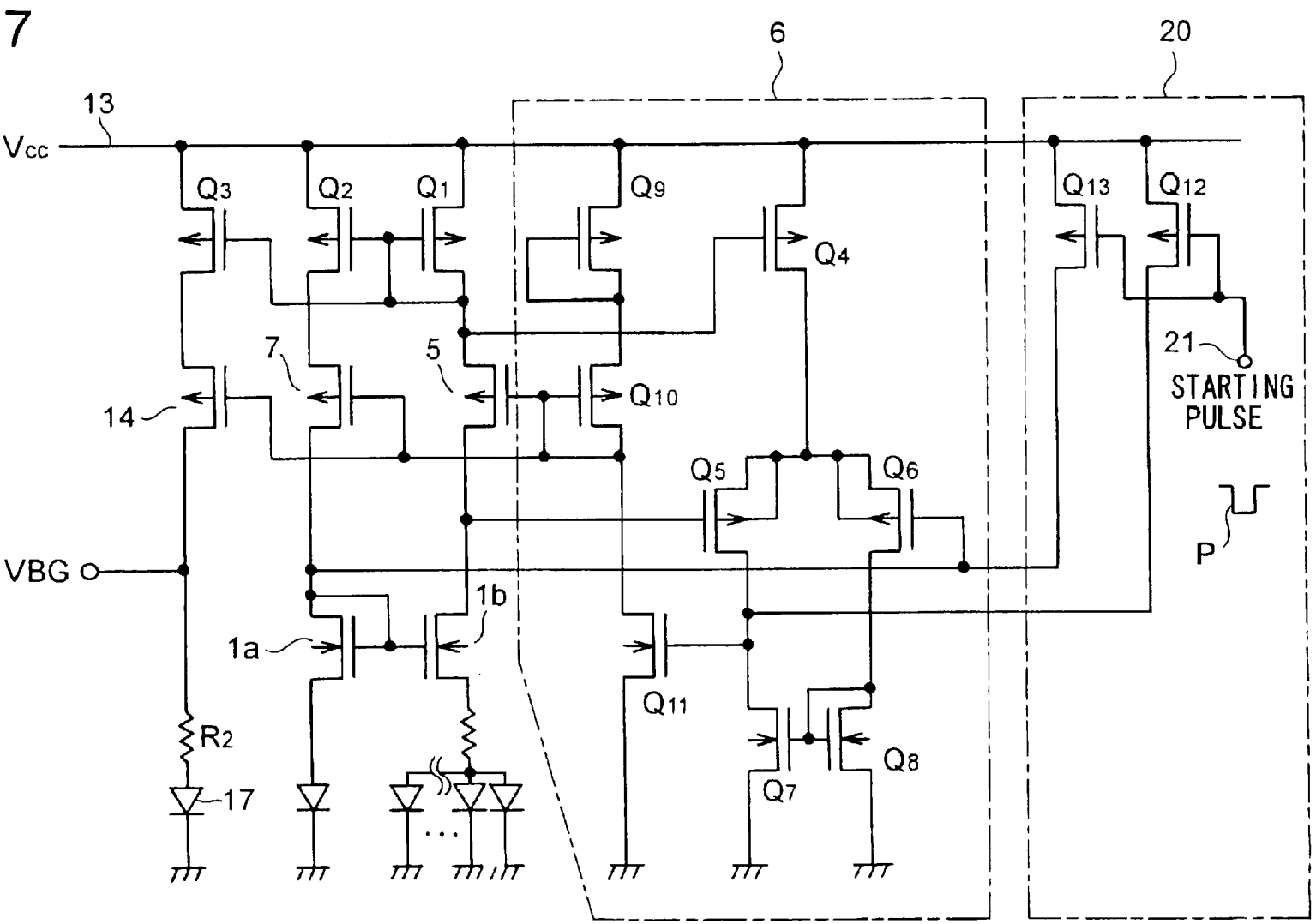
FIG. 7 is a diagram showing a seventh embodiment of the invention.
Figure 8:
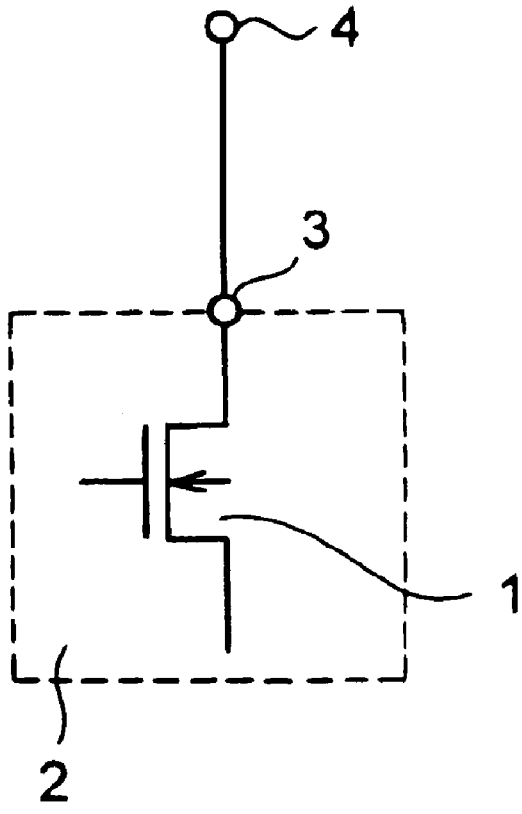
PRIOR ART FIG.8
FIG. 8 is a diagram showing an example of a conventional circuit configuration.

FIG. 7 shows an embodiment obtained by modifying the circuit shown in FIG. 6 so as to be more specific, in which the operational amplifier 6 is replaced with an example of a practical circuit and a starting circuit 20 is additionally provided. In FIG. 7, the operational amplifier 6 is composed of a P-channel MOS transistor $Q_4$ that serves as a constant current source, P-channel MOS transistors $Q_5$ and $Q_6$ that serve as a differential amplifier, N-channel MOS transistors $Q_7$ and $Q_8$ that serve as a current mirror circuit, and MOS transistors $Q_9$, $Q_{10}$, and $Q_{11}$ that are connected in series between the supply voltage line 13 and ground. On the other hand, the starting circuit 20 is composed of P-channel MOS transistors $Q_{12}$ and $Q_{13}$.

When electric power starts being supplied, a negative starting pulse P is applied from a starting pulse generating circuit (not shown) to a terminal 21, and thus the transistors $Q_{12}$ and $Q_{13}$ are turned on. Then, the drain output of the transistor $Q_{12}$ turns the transistor $Q_{11}$ on, and thus the transistors 5, 7, and 14 are turned on. On the other hand, the drain output of the transistor $Q_{13}$ turns the transistors 1*a* and 1*b* on, and thus the portion of the circuit corresponding to FIG. 6 is started.

What is claimed is:

1. A reference voltage generating circuit comprising:

a first circuit having a pair of first MOS transistors of an N-channel type connected together to form a current mirror circuit, a drain of the output-side first MOS transistor serving as a current output end, a source of the output-side first MOS transistor being connected through a resistor to a plurality of parallel-connected diodes, a drain and a gate of the input-side first MOS transistor serving as a current input end;

first, second, and third terminals;

a second MOS transistor of a P-channel type having a drain thereof connected to the current output end and having a source thereof connected to the first terminal;

a third MOS transistor of a P-channel type having a drain thereof connected to the current input end and having a source thereof connected to the second terminal;

an operational amplifier having a first input terminal thereof connected to the current output end, having a second input terminal thereof connected to the current input end, and having an output terminal thereof connected to gates of the second and third MOS transistors, the operational amplifier operating so as to keep a voltage at the current output end equal to a voltage at the current input end;

a fourth MOS transistor of a P-channel type having a source thereof connected to the third terminal and having a gate thereof connected to the gates of the second and third MOS transistors;

a voltage extraction circuit connected to a drain of the fourth MOS transistor;

a reference voltage extraction terminal connected to a node between the fourth MOS transistor and the voltage extraction circuit; and a current mirror circuit composed of fifth, sixth, and seventh MOS transistors of a P-channel type having sources thereof connected to a supply voltage line, wherein the first terminal is connected to a drain and a gate of the fifth MOS transistor and to gates of the sixth and seventh MOS transistors, the second terminal is connected to a drain of the sixth MOS transistor, and the third terminal is connected to a drain of the seventh MOS transistor.

2. A reference voltage generating circuit as claimed in claim 1, further comprising:

a starting circuit for feeding a starting current to the current input end and to the gate of the second MOS transistor.

3. A semiconductor integrated circuit comprising:

a first circuit comprising an input-side N-channel MOS transistor and an output-side N-channel MOS transistor, each MOS transistor having a gate, wherein the gates are effectively connected such that a current mirror circuit is formed, a diode connected between a source of the input-side transistor and ground, and a plurality of diodes connected in parallel between a source of the output-side transistor and ground through a resistor;

a current output node to which a drain of the output-side transistor is connected;

a current input node to which a drain of the input-side transistor is connected;

a first terminal;

a P-channel MOS transistor having a drain thereof connected to the current output node and having a source thereof connected to the first terminal; and an operational amplifier comprising a first input terminal thereof connected to the current output node, a second input terminal thereof connected to the current input node, and an output terminal thereof connected to a gate of the P-channel transistor, wherein the operational amplifier operates so as to keep a voltage at the current output node equal to a voltage at the current input node;

wherein the gates of the input-side transistor and the output-side transistor are connected to the current input node so as to maintain a ratio between a current flowing at the current input node and a current flowing at the current output node, and the voltage at the current input node is set and maintained such that a drain-to-source voltage of the output-side transistor is sufficiently low to prevent hot carriers even if a voltage at the first terminal rises.

* * * * *